US007370712B2

(12) United States Patent
Stout et al.

(10) Patent No.: US 7,370,712 B2
(45) Date of Patent: May 13, 2008

(54) UNDER REAMER

(75) Inventors: Mark Clifton Stout, Edmonton (CA); Cristian Mihai Catrinescu, Calgary (CA); Bruno H. Walter, North Vancouver (CA)

(73) Assignee: Tesco Corporation, Calgary, Alberta (CA)

( * ) Notice: Subject to any disclaimer, the term of this patent is extended or adjusted under 35 U.S.C. 154(b) by 188 days.

(21) Appl. No.: 10/468,856

(22) PCT Filed: May 29, 2003

(86) PCT No.: PCT/CA03/00797

§ 371 (c)(1),
(2), (4) Date: Nov. 15, 2004

(87) PCT Pub. No.: WO03/102354

PCT Pub. Date: Dec. 11, 2003

(65) Prior Publication Data

US 2005/0205305 A1 Sep. 22, 2005

(30) Foreign Application Priority Data

May 31, 2002 (CA) ..... 2388793

(51) Int. Cl.
*E21B 7/28* (2006.01)

(52) U.S. Cl. ..... 175/265; 175/266; 175/269; 175/271; 175/273; 175/279; 175/287; 175/290

(58) Field of Classification Search ..... 175/263, 175/265–267, 269, 271, 273, 279, 284, 286, 175/287, 290, 291
See application file for complete search history.

(56) References Cited

U.S. PATENT DOCUMENTS 2,116,903 A * 5/1938 Macclatchie et al. ..... 175/269
2,809,016 A * 10/1957 Kammerer, Jr. ..... 175/267
3,568,784 A * 3/1971 Kammerer, Jr. ..... 175/290
3,712,854 A * 1/1973 Thometz et al. ..... 175/269
5,111,893 A * 5/1992 Kvello-Aune ..... 175/269
5,735,359 A * 4/1998 Lee et al. ..... 175/269
7,195,080 B2 * 3/2007 De Luca ..... 175/269

FOREIGN PATENT DOCUMENTS

WO WO 00/31371 6/2000

* cited by examiner

*Primary Examiner*—Richard E. Chilcot, Jr.
*Assistant Examiner*—Matthew J Smith
(74) *Attorney, Agent, or Firm*—Bracewell & Giuliani LLP

(57) ABSTRACT

An under reamer for expanding a borehole through an earthen formation is taught. The under reamer includes: a mandrel including an end for connection into a drill string and an opposite end and a housing including an inner bore, telescopically disposed over the mandrel and axially moveable relative to the mandrel but rotationally moveable with the mandrel. A plurality of under reamer arms are carried on the housing, the under reamer arms are formed as blocks including cutter-supporting portions in which poly-crystalline diamond compact cutters are mounted. The under reamer arms are moveable by driving the housing axially over the mandrel between a retracted position extending into the bore of the housing and an expanded position wherein the under reamers arms are pivoted out of the housing inner bore and supported therebehind by the mandrel such that the cutter-supporting portions are exposed for use to enlarge a borehole. The under reamer can include one or more lock assemblies for releasably locking the mandrel and housing against relative axial movement. The under reamer can also or alternately include a restriction nozzle to facilitate hydraulic operation thereof.

33 Claims, 12 Drawing Sheets

UNDER REAMER

FIELD OF THE INVENTION

This invention is directed to an under reamer for operating behind a pilot bit.

BACKGROUND OF THE INVENTION

When drilling a borehole through an earthen formation a pilot hole is drilled by a pilot bit and the hole can be enlarged by an under reamer. Under reamers have arms with cutters thereon that cut into the formation to enlarge the borehole to its intended gauge.

Under reamers are useful in casing drilling, wherein the pilot bit must be of a size to pass through the bore of the casing and is, therefore, not sized to drill a borehole of a gauge that the casing can pass therethrough. Therefore, the pilot bit drills the pilot hole into the formation and under reamers enlarge the hole behind the pilot bit to a gauge greater than the casing outer diameter to permit advancement of the casing into the borehole. Under reamers are also useful when extending a borehole below installed casing. In such embodiments, the under reamer arms are collapsible to permit the under reamer to be moved through the bore of the casing and are expandable downhole to permit drilling of a borehole to a gauge greater than the outer diameter of the casing.

SUMMARY OF THE INVENTION

An under reamer has been invented, which facilitates tripping through the casing inner bore and facilitates deployment of the under reamer arms down hole.

In accordance with one broad aspect of the present invention there is provided an under reamer for expanding a borehole through an earthen formation, the under reamer comprising: a mandrel including an end for connection into a drill string and an opposite end; a housing including an inner bore, telescopically disposed over the mandrel and axially moveable relative to the mandrel, the housing being rotationally moveable with the mandrel; and a plurality of under reamer arms carried on the housing, the under reamer arms formed as blocks including cutter-supporting portions in which poly-crystalline diamond compact cutters are mounted, the under reamer arms being moveable by driving the housing axially over the mandrel between a stored position extending into the inner bore of the housing and an expanded position wherein the under reamer arms are pivoted out of the housing inner bore and supported by the mandrel such that the cutter-supporting portions are exposed for use to enlarge a borehole.

The axial movement of the housing relative to the mandrel can be driven by weight on bit or by fluid pressure inside the drill string. In one embodiment, the under reamer includes a hydraulic pressure chamber between the housing and the mandrel for driving the housing axially relative to the mandrel.

The under reamer can include slots in the housing extending between the housing outer surface and the housing inner bore wherein the under reamer arms are pivotally mounted. The slots permit the rear surfaces of the under reamer arms to be open for driving contact with the mandrel. A portion of the rear surfaces can be wedge-shaped to permit the under reamer arms to fit together in the housing inner bore about the inner bore center axis. In addition or alternately, the under reamer rear surfaces can be formed to substantially conform to the outer surface contour of the portion of the mandrel which is positioned behind the arms when they are in the expanded position. This enhances the support provided by the mandrel for the arms, when the arms are in the expanded position.

In accordance with another aspect of the present invention, there is provided an under reamer for enlarging a borehole through an earthen formation, the under reamer comprising: a mandrel including an end for connection into a drill string and an opposite end; a housing telescopically disposed over the mandrel and axially moveable relative to the mandrel, the housing being rotationally moveable with the mandrel; a plurality of under reamer arms carried on the housing, the under reamer arms each including a cutter-supporting portion; and a slot for each under reamer arm, the slots extending from the outer surface of the housing to the housing inner bore; the under reamer arms each being pivotally moveable within their slots between a stored position in the slot and extending into the inner bore and an expanded position wherein the cutter-supporting portions extend beyond the outer surface of the housing for use to enlarge a borehole.

The sides of the slots can be formed to substantially conform to the shape of the sides of the arms, so that the arms are supported by the slots. Preferably, the arms are formed such that, in the expanded position, they remain at least in part in the slot with their cutter supporting portions extending from the slot.

The upper ends of the slots can be formed to limit the pivotal movement of the arms into their extended position by abutment of the arm upper surfaces against the upper ends of the slots. The upper ends of the slots can substantially conform to the shape of the upper surfaces of the under reamer arms, to enhance transfer of shock to the housing.

The under reamer can include a releasable lock between each under reamer arm and the slot in which it is mounted to releasably lock the under reamer arm in the stored position within the slot.

In accordance with another aspect of the present invention, there is provided an under reamer for enlarging a borehole through an earthen formation, the under reamer comprising: a mandrel including an end for connection into a drill string and an opposite end; a housing telescopically disposed over the mandrel and axially moveable relative to the mandrel, the housing being rotationally moveable with the mandrel; a plurality of under reamer arms carried on the housing, the under reamer arms including cutter-supporting portions and being moveable by driving the housing axially over the mandrel between a stored position against the housing and an expanded position wherein the cutter-supporting portions are exposed for use to enlarge a borehole; and a lock for releasably locking the housing in relative axial position on the mandrel.

The lock can releasably lock the housing in a position on the mandrel to maintain the under reamer arms in the stored position or, alternately, the lock can releasably lock the housing in an operational position on the mandrel to maintain the under reamer arms in the expanded position. In one embodiment, the operational lock is actuated to unlock by application of fluid pressure to the under reamer, the fluid pressure being selected to be greater than that present during tripping of the under reamer.

In accordance with another aspect of the present invention, there is provided an under reamer for expanding a borehole through an earthen formation, the under reamer comprising: a mandrel including an uphole end for connection into a drill string and an opposite end and an inner bore extending between the uphole end and the opposite end; a housing including an inner bore, telescopically disposed over the mandrel and axially moveable relative to the mandrel, the housing being rotationally moveable with the mandrel; a plurality of under reamer arms carried on the housing, the under reamer arms each including a cutter-supporting portion in which cutters are mounted, the under reamer arms being moveable by driving the housing axially over the mandrel between a stored position extending into the inner bore of the housing and an expanded position wherein the under reamers arms are pivoted out of the housing inner bore and supported by the mandrel such that the cutter-supporting portions are exposed for use to enlarge a borehole; a fluid pressure chamber positioned between the housing and the mandrel and formed to accept pressurized fluid therein to drive the axial movement of the housing relative to the mandrel, a port from the mandrel inner bore to the pressure chamber to permit flow of pressurized fluid therethrough; and a restriction nozzle in the mandrel inner bore between the port and the opposite end of the mandrel to increase fluid pressure thereabove.

The housing inner bore can formed as a fluid diffuser to restore fluid pressure passing through to the pilot bit.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1A:
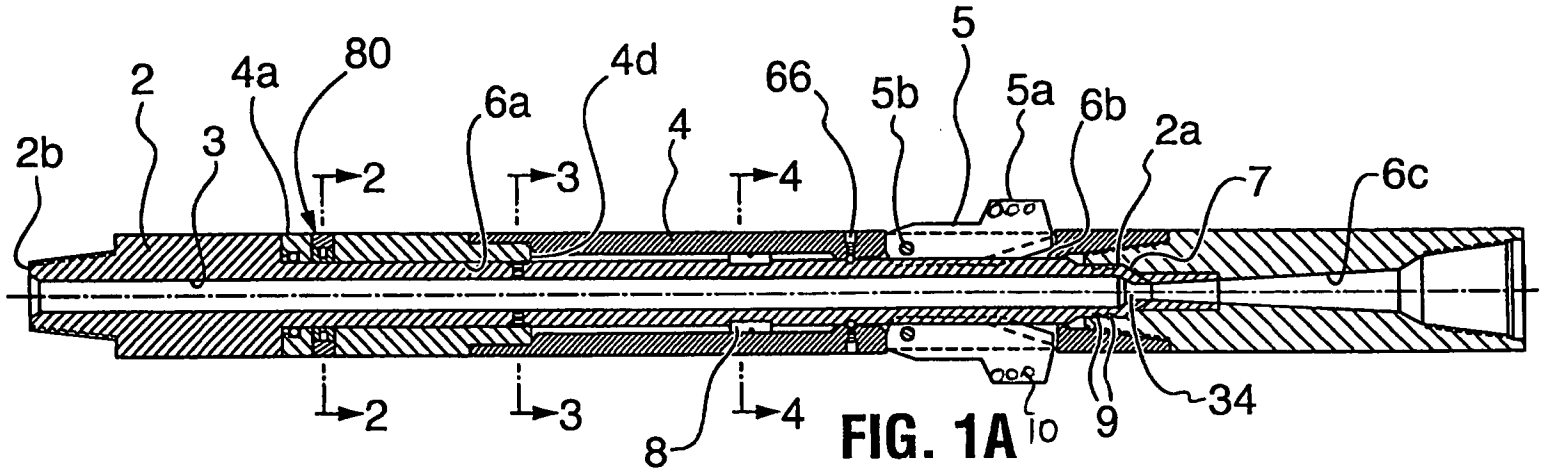
FIG. 1A is an axial sectional view through an under reamer in accordance with the present invention, with the under reamer arms in the expanded position.
Figure 1B:
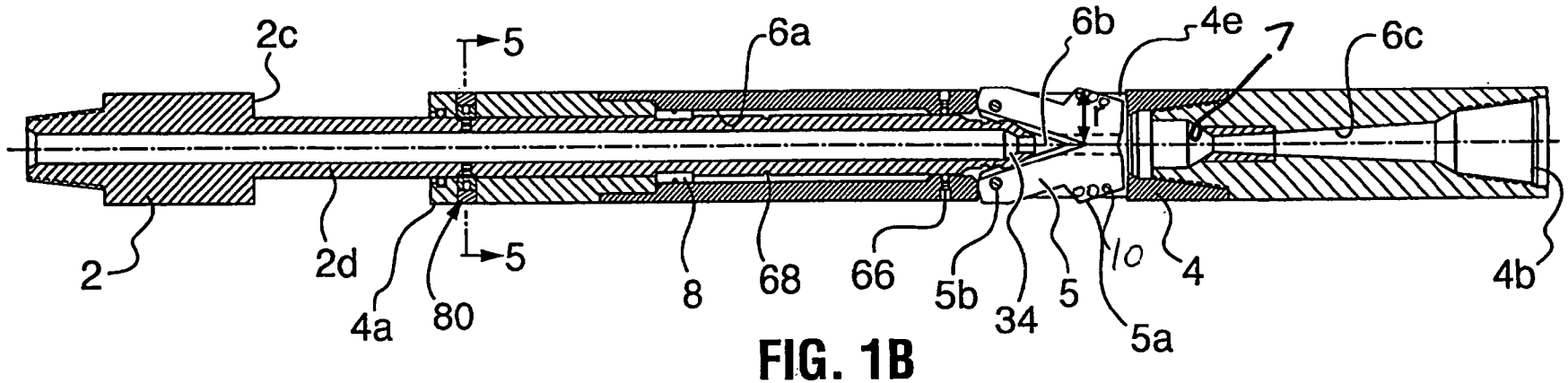
FIG. 1B is an axial sectional view of the under reamer of FIG. 1A with the under reamer arms in the retracted position.
Figure 2:
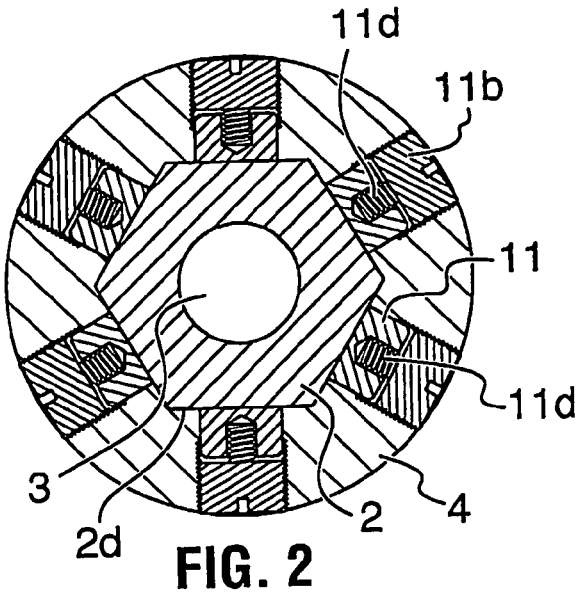
FIG. 2 is a transverse sectional view through the under reamer of FIG. 1A taken along line 2-2.
Figure 3:
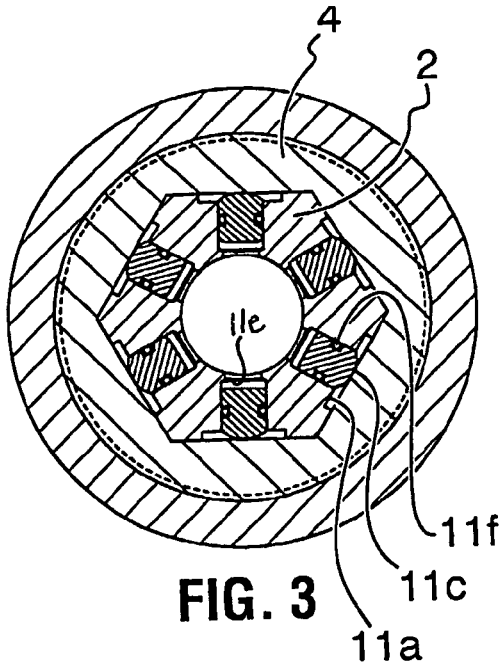
FIG. 3 is a transverse sectional view through the under reamer of FIG. 1A taken along line 3-3.
Figure 4:
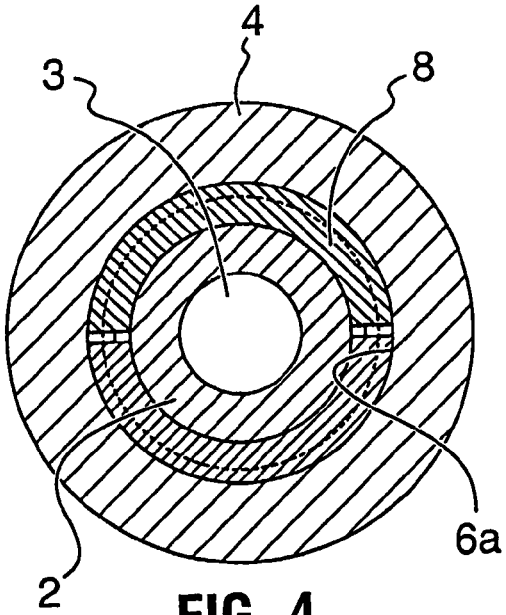
FIG. 4 is a transverse sectional view through the under reamer of FIG. 1A taken along line 4-4.
Figure 5:
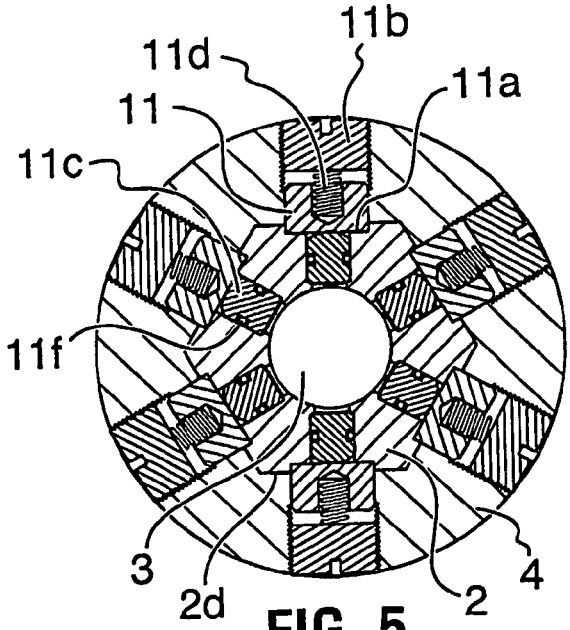
FIG. 5 is a transverse sectional view through the under reamer of FIG. 1B taken along line 5-5.
Figure 6A:
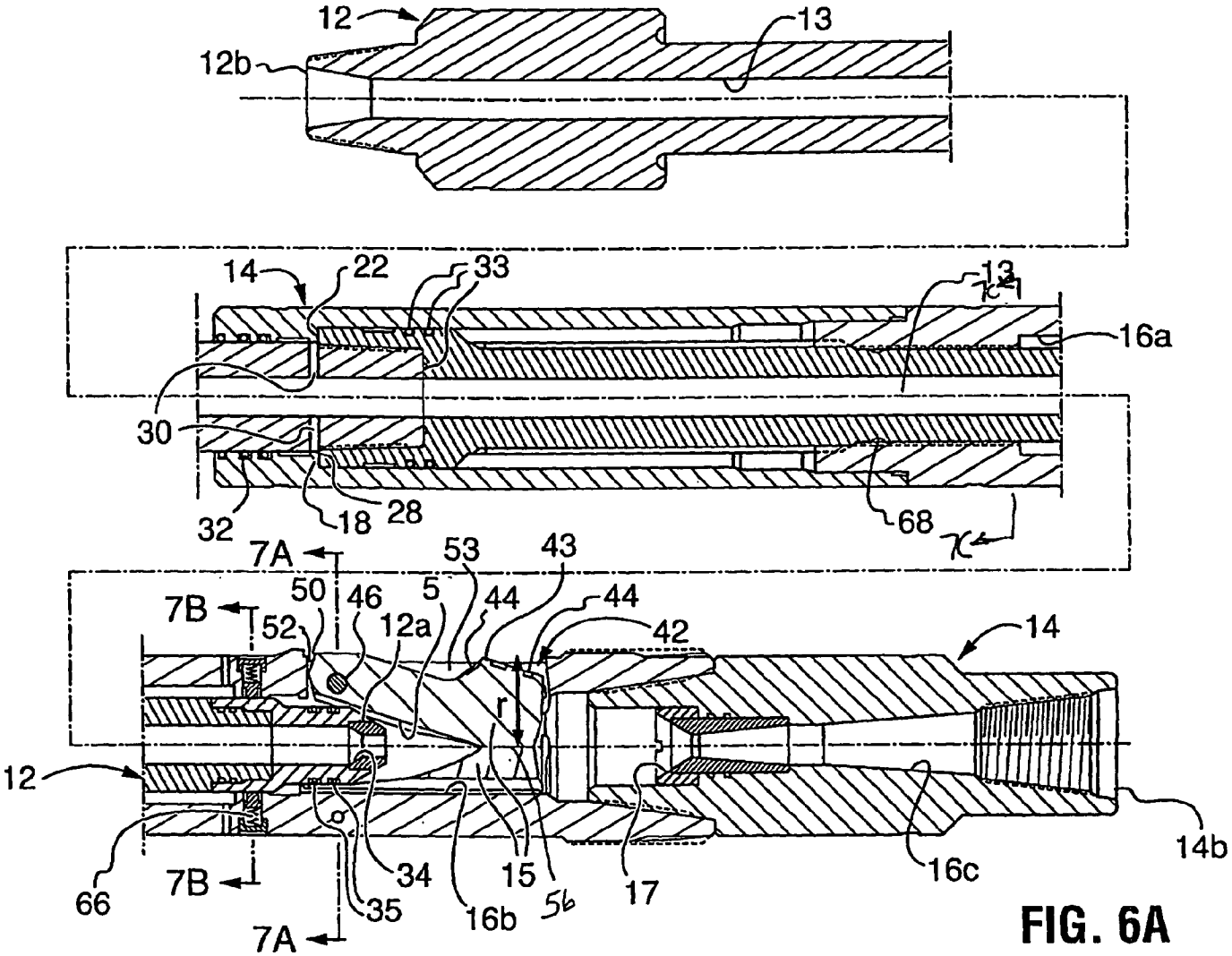
FIG. 6A is an axial sectional view through another under reamer in accordance with the present invention, with the under reamer arms in the retracted position.
Figure 6B:
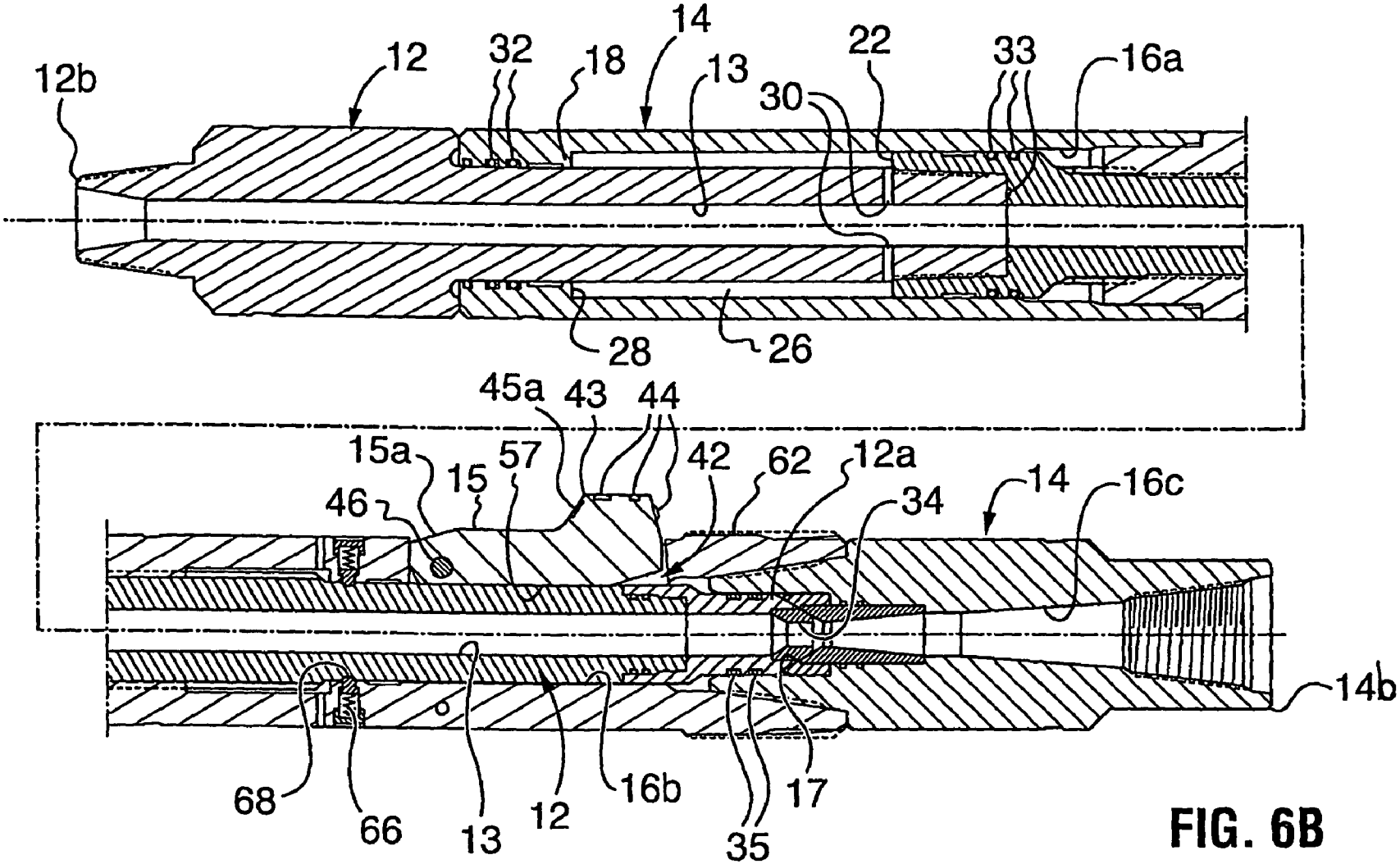
FIG. 6B is an axial sectional view of the under reamer of FIG. 6A with the under reamer arms in the expanded position.
Figure 6C:
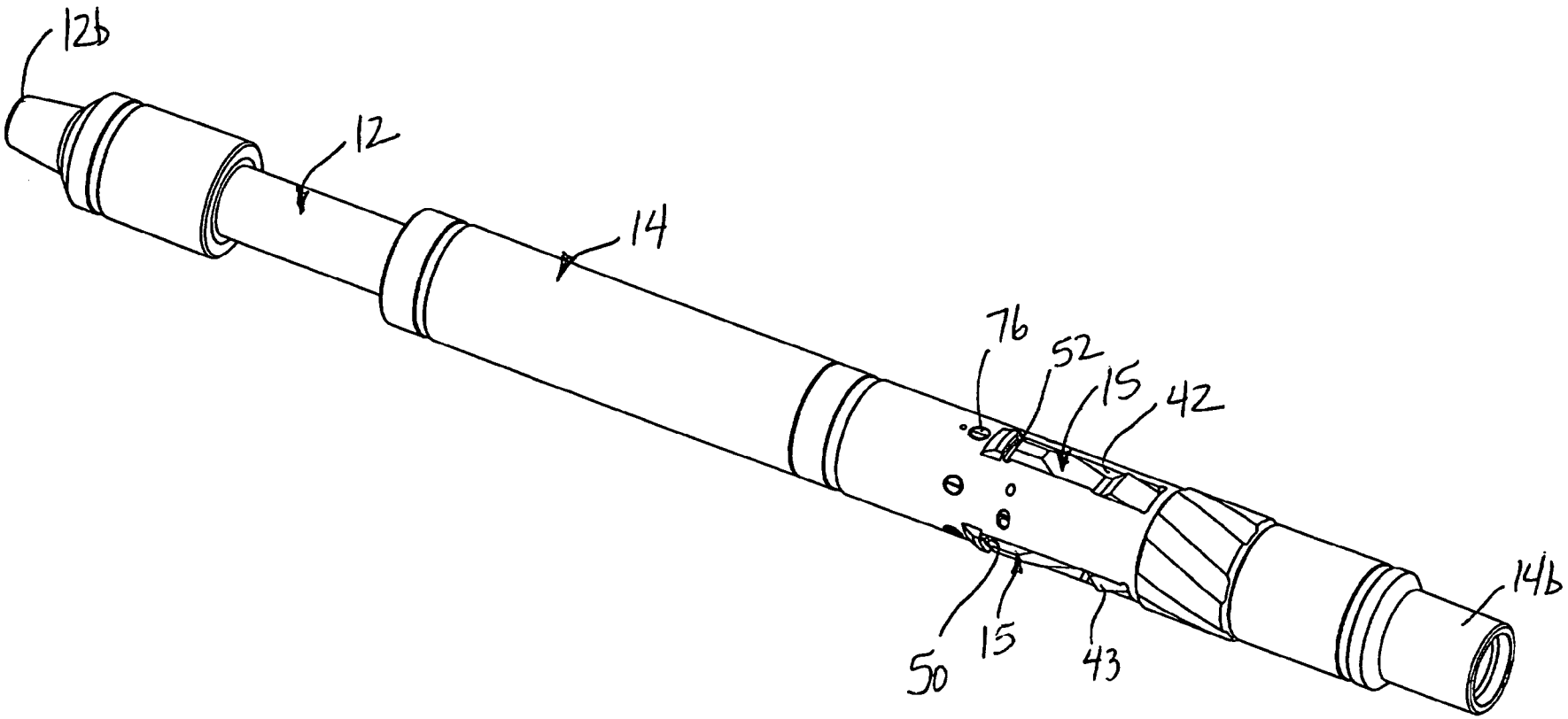
FIG. 6C is a perspective view of the under reamer of FIG. 6A.
Figure 6D:
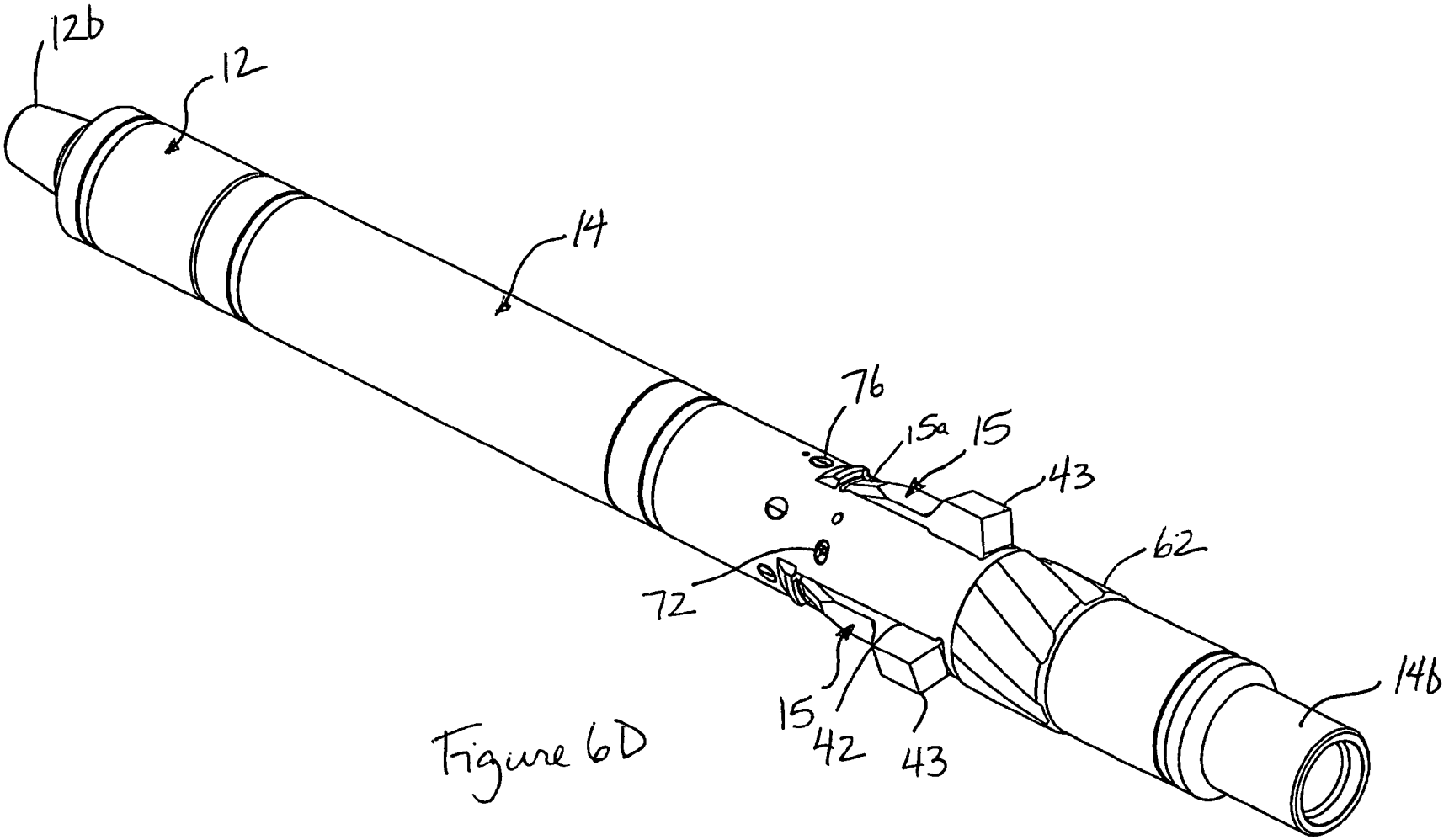
FIG. 6D is a perspective view of the under reamer of FIG. 6B.
Figure 7B:
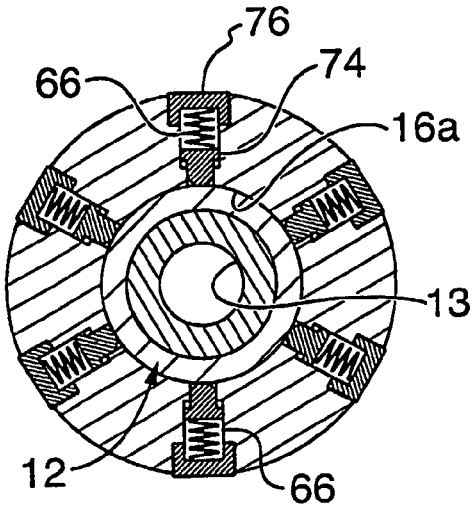
FIG. 7B is a transverse sectional view through the under reamer of FIG. 6A taken along line 7B-7B.
Figure 7A:
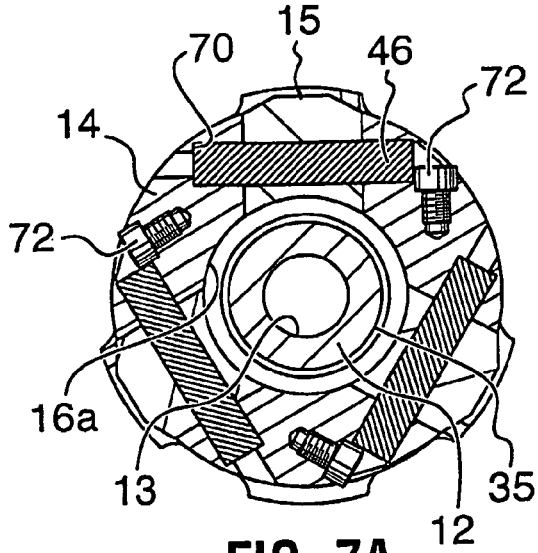
FIG. 7A is a transverse sectional view through the under reamer of FIG. 6A taken along line 7A-7A.
Figure 7C:
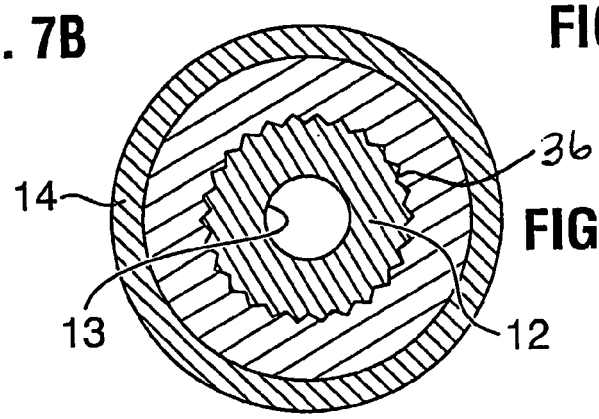
FIG. 7C is a transverse sectional view through the under reamer of FIG. 6A along line 7C-7C.

The Figures show under reamers according to the present invention. As will be appreciated, under reamers are useful to act behind a pilot bit to enlarge a borehole. The under reamer is engaged at the lower end of a drill string. If the under reamer is used when drilling with casing, the drill string is a string of casing and the under reamer is releasably locked to the string of casing by, for example, a drilling lock assembly. The under reamer and pilot bit are rotated either by rotation of the casing string from surface or by use of a mud motor that is positioned between the under reamer and the drilling lock assembly.

The under reamer of FIGS. 1 to 5 includes a mandrel 2 and a housing 4, which carries a plurality of under reamer arms 5. The under reamer arms are mounted in slots 4*e* on the housing and are moveable between an expanded position (FIG. 1A) wherein they are exposed for use to enlarge the well bore and a retracted position (FIG. 1B), wherein they are retracted against or into the housing. The under reamer arms are moveable between the stored position and the expanded position by relative axial movement of the mandrel and the housing. In particular, when housing 4 is in a lower position relative to the mandrel, under reamer arms 5 are in or can be driven into the stored position and when housing 4 is moved upwardly over mandrel 2, such that the mandrel is inserted further into the housing, the under reamer arms are driven out to the expanded position.

Mandrel 2 includes a lower end 2*a* and an upper end 2*b*. In the illustrated embodiment, upper end 2*b* is formed as a threaded pin for connection into the drill string. Of course, end 2*b* can be formed in other ways, as desired. Mandrel 2 also includes an inner bore 3.

Housing 4 includes an upper end 4*a* and a lower end 4*b* formed as a threaded box for connection directly or indirectly to the pilot bit. End 4*b* can be formed in other ways for connection to the pilot bit. Housing 4 further includes an upper inner bore 6*a*, a middle inner bore 6*b*, a lower inner bore 6*c*, which together form an axial bore from end 4*a* to end 4*b*. A shoulder 7 is positioned between middle inner bore 6*b* and lower inner bore 6*c*.

Mandrel 2 is positioned in the upper and the middle inner bores of housing 4 and the housing 4 is slidably mounted to move axially over mandrel 2, as limited by abutment of a shoulder 2*c* on the mandrel against end 4*a* of the housing and abutment of shoulder 4*d* on the housing against a shoulder formed by a split ring 8 mounted on the mandrel.

When the under reamer is not in operation, housing 4 is normally in a lower position relative to the mandrel wherein shoulder 4*d* abuts against split ring 8. In this position, the mandrel is pulled up out of middle inner bore 4*b* with end 2*a* spaced from shoulder 7. For operation of the under reamer, however, housing 4 is driven to an upper position on the mandrel wherein end 4*a* abuts against shoulder 2*c* and end 2*a* is positioned close to shoulder 7. Housing 4 is driven upwardly by applying weight on the pilot bit, wherein the housing will be held stationary while the mandrel and the attached drill string is moved down.

When end 2*a* of mandrel is positioned adjacent shoulder 7, inner bore 3 of mandrel is in communication with lower inner bore 6*c* of the housing. Seals 9 are provided to seal between end 2*a* and housing 4 when end 2*a* of mandrel is positioned adjacent shoulder 7, to seal against fluid flow between the mandrel and the housing past shoulder 7.

While housing 4 and mandrel 2 can move axially with respect to each other, they are restricted from relative rotational movement by an interlock arrangement such as a hex-shaped area 2*d*, or other arrangement, on the mandrel that mates with a similarly shaped area on the housing. The interlock arrangement ensures that torque applied to the mandrel is transferred to the housing and thereby to the plurality of under reamer arms 5 mounted in slots 4*e* on the housing.

Under reamer arms 5 have cutters 10 mounted in cutter supporting portions 5*a* at their outer ends and are pivotally connected at their opposite ends by pins 5*b* to housing 4. The pivotal connection via pins 5*b* permits arms 5 to move between a stored position within slots 4*e* and a radially expanded position wherein cutter supporting portions 5*a* extend out from slots 4*e* past the outer surface of housing 4. In the radially expanded position cutters 10 on portions 5*a* are exposed for enlarging the well bore. The position of each under reamer arm in the radially expanded position is limited by abutment of it the arm against a side of or catch on the slot.

Under reamer arms 5 are mounted to extend into middle inner bore 6*b* of the housing in the space between shoulder 7 and end 2*a* of the mandrel, when the mandrel is drawn up out of the housing bore. As such, to reduce the effective outer radius, r, of the under reamer in the region of the arms in the stored position, arms 5 preferably are formed to abut against one another at or about the center axis of the middle inner bore 6*b*. To further reduce the effective outer radius, r, of the arms 5 in the stored position, their rear surfaces can be formed to fit closely together.

In operation, it is advantageous that arms 5 not retract every time there is a pressure drop. Thus, in one embodiment, there is provided a releasable operational lock assembly to lock mandrel 2 and housing 4 in the operating position. In the illustrated embodiment of FIGS. 1A and 1B, the operational releasable lock assembly includes a plurality of spring-biased detents 66 arranged in the housing to act inwardly to engage in a groove 68 formed in an outer surface of the mandrel. The spring force of detents 66 is selected to be greater than the force generated by the weight of housing 4, arms 5, the pilot bit (not shown) and other components below the housing which would tend to pull the housing down over the mandrel. However, the spring force of the detents 66 can be overcome to move the housing down and allow retraction of under reamer arms 5 when a selected force is applied, such as the force generated by pulling the under reamer arms against the bottom end of the casing when the under reamer is pulled up into the casing to be tripped to surface. Other operational locks can be used such as for example one in which the detents are positioned in the mandrel to engage a groove in the housing, one in which the detents are replaced by a c-ring or one including knurled areas positioned on the mandrel and the housing to interengage.

In the illustrated embodiments of FIGS. 1 to 5, the under reamer also includes a releasable tripping lock assembly 80 for releasably locking the housing in position on the mandrel with the mandrel pulled up out of middle inner bore 4*b*. This is useful during tripping the under reamer through the casing. For example, this tripping lock assembly prevents the mandrel and housing from moving axially relative to each other during tripping, thereby, for example, avoiding the arms from being driven out while the under reamer is inside the casing. The tripping lock assembly 80 includes a plurality of spring-biased plugs 11 mounted in the housing that engage in recesses 11*a* formed on the mandrel surface. Plugs 11 are normally biased by springs 11*d* against mandrel and will drop into recesses 11*a*, when the recesses are aligned therebelow, thus locking the position of the housing relative to the mandrel. Recesses 11*a* are positioned on the mandrel such that they align below plugs 11, when the housing is in the tripping position on the mandrel. The plugs can be moved against the force in springs 11*d* to drive the plugs out of the recesses by pressure actuated pins 11*c* disposed in holes extending from the mandrel inner bore 3 to recesses 11*a* on the mandrel. Pins 11*c* can be pushed inwardly toward inner bore 3, as limited by return 11*e*, and can be pushed outwardly into the recesses, as limited by abutment against the housing or plugs 11. Seals 11*f* seal against passage of fluid about pins 11*c* and ensure that fluid pressure acts against the bore-facing surfaces of the pins. In operation of the tripping lock assembly, during tripping of the under reamer, housing 4 is positioned such that plugs 11 are biased into recesses 11*a*. During tripping there is insufficient fluid pressure to drive pins 11*c* against plugs 11 such that they remain in the recesses. However, when drilling is desired to be initiated, fluid is pumped into the drill string, which is in communication with bore 3. Eventually there is sufficient pressure in bore 3 such that pins 11*c* are driven out against plugs 11 so that they no longer engage in recesses 11*a*. This releases the lock between the mandrel and the housing such that the housing can move upwardly over the mandrel when weight is applied to the pilot bit. The force in springs 11*d* is selected to limit the ability of pins 11*c* to push plugs 11 out of the recesses. The force is selected such that springs 11*d* will not collapse against the fluid pressures present in the drill string during tripping, but can be collapsed by fluid pressures present in the mandrel just below those pressure generated during drilling.

To facilitate assembly, plugs 11 can be mounted in the housing by use of threaded keepers 11*b*.

To assist in the generation of sufficient pressures, bore 3 has formed or positioned therein a restriction nozzle 34 to increase the pressure in the mandrel inner bore above the nozzle and against the inner bore-facing surfaces of pins 11*c*. Restriction nozzle 34 acts as to increase the pressure differential between the fluid pressure in the mandrel bore and the pressure external to the tool in the borehole in which the under reamer is operated.

Referring to FIGS. 6A to 8, another under reamer according to the present invention is shown. The illustrated under reamer can be actuated both by application of weight on bit, as in the under reamer described hereinabove, and by application of fluid pressure to the mandrel bore.

The under reamer includes a mandrel 12 and a housing 14, which carries a plurality of under reamer arms 15. The under reamer arms are moveable between a retracted position (FIG. 6A), wherein they are retracted against or into the housing and an expanded position (FIG. 6B) wherein they are exposed for use to enlarge the well bore. The under reamer arms are moveable between the retracted position and the expanded position by relative axial movement of the mandrel and the housing. In particular, when housing 14 is in a lower position relative to the mandrel, under reamer arms 15 are in, or can be driven into, the retracted position and when housing 14 is moved upwardly over mandrel 12, such that the mandrel is inserted further into the housing, the under reamer arms are driven out to the expanded position.

Mandrel 12 includes a lower end 12*a* and an upper end 12*b*, which in the illustrated embodiment is formed as a threaded pin for connection to the drilling lock assembly or another component for eventual connection to the drill string. Mandrel 12 further includes an inner bore 13.

Housing 14 includes an upper end and a lower end 14*b* formed as a threaded box for connection directly or indirectly to the pilot bit. Housing 14 further includes an upper inner bore 16*a*, a middle inner bore 16*b*, a lower inner bore 16*c* and a shoulder 17 between the middle and lower inner bores.

Mandrel 12 is positioned in the upper inner bore of housing 14 and housing 14 is slidably mounted to move axially over mandrel 12 as limited by abutment of shoulder 18 on housing with shoulder 22 on the mandrel. When the under reamer is not in operation, housing 14 is normally in a lower position relative to mandrel wherein shoulder 18 abuts against shoulder 22 and end 12*a* is spaced from shoulder 17. However, for operation of the under reamer, housing 14 is driven to an upper position on mandrel 12, wherein the mandrel extends into middle inner bore 16*b* and end 12*a* is adjacent shoulder 17. Housing 14 can be driven upwardly in two ways, first by injection of hydraulic fluid into a chamber 26 formed between the housing and the mandrel and/or, second, by applying weight on the pilot bit. In particular, in chamber 26 a piston face 28 is formed on the housing against which fluid pressure can act to drive the housing along mandrel 12. Piston face 28 is in communication with inner bore 13 of the mandrel via ports 30, such that fluid pressure applied from surface can be communicated through bore 13 and into chamber 26. Seals 32, 33 act between the housing and the mandrel to contain fluid pressure within the chamber.

To enhance operation of chamber 26 to move housing 14 upwardly over the mandrel, bore 13 has formed or positioned therein a restriction nozzle 34 to increase the pressure in the mandrel inner bore above the nozzle, in ports 30 and in chamber 26. Restriction nozzle 34 acts as to increase the pressure differential between the fluid pressure in these areas and the pressure external to the tool in the borehole in which the under reamer is operated.

When end 12*a* of the mandrel is in close proximity to shoulder 17, inner bore 13 of mandrel is in communication with lower inner bore 16*c* of the housing. Since it is desirable to achieve jetting into the housing lower inner bore 16*c*, seals 35 are provided at the interface to seal against fluid flow therebetween when the mandrel is positioned close to the shoulder 17. Lower inner bore 16*c* is formed as a diffuser, having an increasing inner diameter from shoulder 17 toward end 14*b*, to recover the pressure loss created by restriction nozzle 34. Thus, even though nozzle 34 is installed in the under reamer, the fluid pressure is not compromised at the pilot bit nozzles.

While housing 14 and mandrel 12 can move axially with respect to each other, they are restricted from relative rotational movement by an interlock arrangement such as a splined surface 36 on the mandrel that mates with a correspondingly shaped area on the housing. The interlock arrangement ensures that torque applied to the mandrel is transferred to the housing and thereby to the plurality of under reamer arms 15 mounted in slots 42 on the housing.

Under reamer arms 15 include cutter supporting portions 43 at their outer ends and are pivotally connected at their opposite ends by pins 46 to housing 14. The pivotal connections permit arms 15 to move between a stored position within slots 42 and a radially expanded position wherein cutter supporting portions 43 extend out from slots 42 past the outer surface of housing 14. In the radially expanded position cutters 44 on portions 43 are exposed for enlarging the well bore. The position of each under reamer arm in the radially expanded position is limited by abutment of surface 50 against upper end 52 of the slot in which it is mounted.

Under reamer arms 15 are mounted to extend into middle inner bore 16*b* of the housing and, in particular, are positioned on the housing in the space between shoulder 17 and end 12*a* of the mandrel, when housing 14 is in the lower position on the mandrel. As such, arms 15 when in the stored position abut against one another at the center axis of the upper inner bore 16*a*. To reduce the effective outer radius, r, of the under reamer at the arms in the stored position, rear surfaces 56 of the arms can be formed to fit closely together.

Under reamer arms 15, as noted hereinbefore, are driven radially outwardly when the housing is moved upwardly over the mandrel. In particular, the arms are driven outwardly initially by the force of fluid jetting through nozzle 34 and then by abutment of end 12*a* of mandrel against the rear surfaces of the arms. In the expanded position, the mandrel is positioned behind the arms and the arms are held out by the mandrel. To increase the strength of the arms, they are supported about their sides and rear surfaces. In particular, slots 42 are formed at their upper ends 52 and sides 53 to substantially conform to the sides of the arms and at least a portion 57 of the rear surfaces of the arms are formed to substantially conform to the outer surface of the mandrel. In addition, preferably the arms are formed with respect to the slots and the mandrel such that when they are in the expanded position, they are supported along their length within the slot with substantially only cutter supporting portions 43 extending out from the slot. The housing about slots 42 has formed thereon raised surfaces 62 to ream out or engage the hole ahead of the cutters 44.

The housing can also include protrusions 63 above the slot which act as centralizers/spacers spacing the under reamer arms from surfaces such as the ID of the casing during tripping.

In operation, it is advantageous that arms 15 not retract every time there is a pressure drop. Thus, in one embodiment, there is provided a releasable operational lock assembly to lock mandrel 12 and housing 14 in the operating position. In the illustrated embodiment of FIGS. 6 and 7, the releasable lock assembly is a spring-biased detent arrangement including a plurality of spring-biased detents 66 in the housing which engage in a groove 68 in the mandrel. The spring force of detents 66 is selected to be greater than the force generated by the weight of housing 14, arms 15, the pilot bit (not shown) and other components below the housing which would tend to pull the housing down over the mandrel. However, the spring force of the detents 66 can be overcome to move the housing down and allow retraction of under reamer arms 15 when a selected force is applied, such as the force generated by pulling the under reamer arms against the end of the casing to trip the under reamer to surface. Upper surfaces 15*a* of the arms are ramped to facilitate folding down of the under reamer arms when they are butted against the casing.

To facilitate manufacture and assembly, mandrel 12 and housing 14 can be formed in sections as shown and threaded together or secured in some other way. Nozzle 34 and a section of the housing around shoulder 17 are advantageously removable since they are subject to wear by fluid jetting therethrough. Pins 46 are conveniently installed through bores in the housing and secured between shoulders 70 and screws 72. Detents 66 are installed in ports 74 by threaded caps 76.

Figure 8:
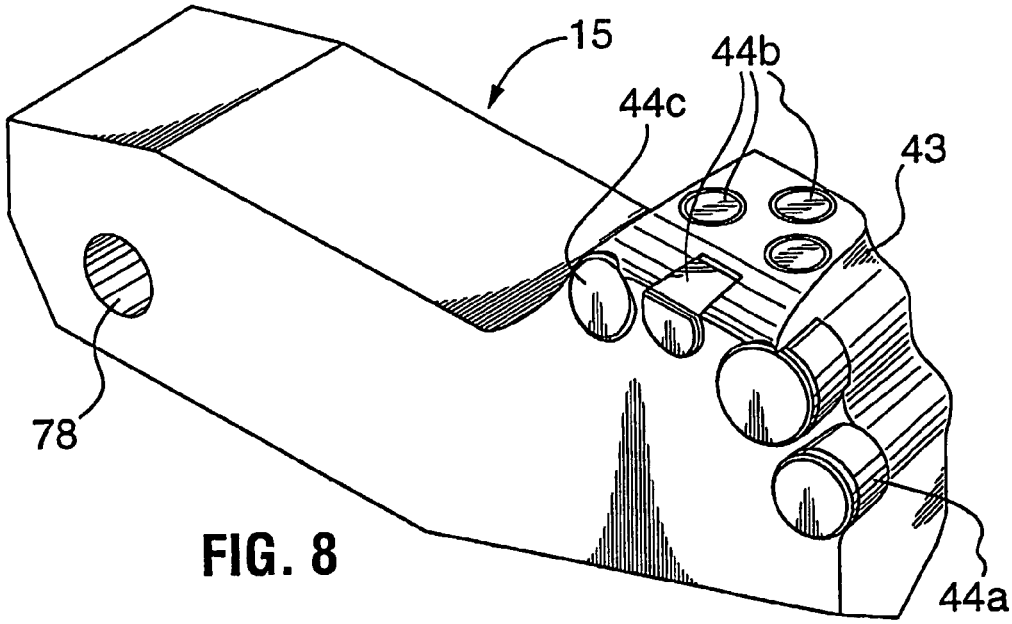
FIG. 8 is a perspective view of an under reamer arm useful in the under reamer of FIG. 6A.

An under reamer arm is shown in FIG. 8 that is useful in under reamers according to the present invention. The under reamer arm includes a bore 78 for accepting pin 46 and at its opposite end a cutter-supporting portion 43 in which are installed a plurality of cutters 44*a*, 44*b*, 44*c*. Arm 15 includes those cutters 44*a* positioned for initially extending the borehole diameter, those cutters 44*b* for maintaining the gauge of the borehole and those cutters 44*c* for use in back reaming, should the under reamer be pulled up hole during operation. In the illustrated embodiment, the cutters are formed of polycrystalline diamond compact (PDC) and the arms are formed as blocks of material. The use of PDC cutters permits the arms to be rugged and the under reamer to be compact and rigid, with significant support for the arms. Hard facing can be used about the cutters to increase the durability of the arm.

Referring to FIGS. 9A to 12D, there is shown another under reamer according to the present invention. The under reamer is generally as shown in FIGS. 6A to 7C but additionally includes a releasable tripping lock assembly 80 for releasably locking the housing to the mandrel during tripping the under reamer through the casing and a releasable under reamer arm lock 92 for locking the under reamer arms into the stored position.

Generally, the under reamer includes a mandrel 12, a housing 14 and a plurality of under reamer arms 15, such as those shown in FIG. 8 or according to other embodiments. Mandrel 12 includes a lower end 12*a* and an inner bore 13 with a venturi nozzle 34 formed therein.

Housing 14 includes a lower end 14*b* formed as a threaded box for connection directly or indirectly to the pilot bit. Housing 14 includes an upper inner bore 16*a* and a middle inner bore 16*b* in which mandrel 12 is telescopically disposed. A hydraulic chamber 26 is formed between the housing and the mandrel and includes a piston face 28 formed on housing 14.

Housing 14 further includes a shoulder 17 and therebelow a lower inner bore 16*c* formed as a diffuser.

An interlock arrangement (FIG. 10B) is provided between the mandrel and the housing. The interlock arrangement includes splines 36*a* on the mandrel that are formed to interlock with longitudinal grooves 36*b* in the upper inner bore of the housing.

The under reamer arms include cutter-supporting portions at their outer ends, which have supported therein cutters 44. The under reamer arms 15 are pivotally mounted by pins 46 in slots 42 in a region of the housing adjacent the middle inner bore from which mandrel 12 is retracted when the housing is in the lower position on the mandrel.

The under reamer includes a releasable operational lock assembly including a plurality of spring-biased detents 66 and a groove 68. The under reamer also includes a releasable tripping lock assembly 80 for releasably locking the housing to the mandrel during tripping the under reamer and a releasable under reamer arm lock 92 for locking the under reamer arms into the stored position.

The tripping lock assembly 80 includes a collet 81 mounted on housing 14 in hydraulic chamber 26 and an annular piston 85. Piston 85 forms the upper end of chamber 26 and is biased into chamber 26 by springs 86 acting between the piston and the housing. Seals 87, such as o-rings, seal on either side of the piston to prevent loss of fluid from chamber 26. Fluid pressure can pass through collet 81 and act against face 85*a* of the piston to drive the piston against the force of springs 86. The piston includes a stepped wall 85*b* extending into the chamber along the housing such that a space is formed between mandrel 12 and wall 85*b* of the piston. Stepped wall 85*b* includes a first level 88*a* and a second level 88*b*, wherein the first level 88*a* defines an inner radius greater than that of the second level 88*b*. Collet 81 includes a plurality of lugs 82 biased inwardly by an elastomeric ring 83. The lugs are each mounted, with allowance for pivotal movement at their base end into an annular return 84 fixed on the housing. The opposite end of each lug are positioned between and can move radially inwardly and outwardly, relative to their base end mounting between mandrel 12 and stepped wall 85*b*. Since lugs 82 are mounted at their bases to housing 14, movement of piston 85 in the chamber drives wall 85*b* past lugs 82 so that the lugs can move between a position contacting first level 88*a* and a position contacting second level 88*b*. Collet 81 and piston 85 move along with the housing as it rides along mandrel 12. Collet 81 is formed to lock against a shoulder 89 on the mandrel, as will be more fully described hereinafter.

Releasable under reamer arm lock 90 includes a plurality of spring-biased detents 92 mounted to engage between slots 42 and arms 15. In particular, in the illustrated embodiment, a spring-biased detent 92 is positioned in each slot 42 to engage into a recess 94 formed on the arm in that slot, the recess and detent are positioned to align when the arm is in the stored position in the slot. The spring force in each detent is sufficient to hold its associated under reamer arm against expanding out of its slot by gravity but can be easily overcome by application of force greater than gravity to the arm. It is to be understood that although one releasable under reamer arm lock has been described and illustrated, other under reamer arm locks can be used in accordance with the present invention. Preferably, an under reamer arm lock according to the present invention can be repeatedly locked and unlocked without manual adjustment. In particular, the arm lock can be unlocked to permit expansion of the arms, then relocked once the arms are retracted and then unlocked again, should the expansion of the arms be again desirable. Other under reamer arm locks can include, for example, a spring biased catch that engages over the upper surface of the arms, but can be overcome to provide for expansion or resilient, for example of rubber, pins, that can be deformed to permit passage thereby of the arms but regain their form to extend in front of the arm when the arm is retracted.

For use, the under reamer mandrel is connected to a drill string, drilling lock assembly or other component for use downhole and a pilot bit is connected directly or indirectly to box end 14*b* of the housing. The under reamer when downhole, is in fluid communication with surface through bore 13 of the mandrel and rotation of the mandrel is transferred to the housing to rotate the under reamer arms and the pilot bit.

Figure 9A:
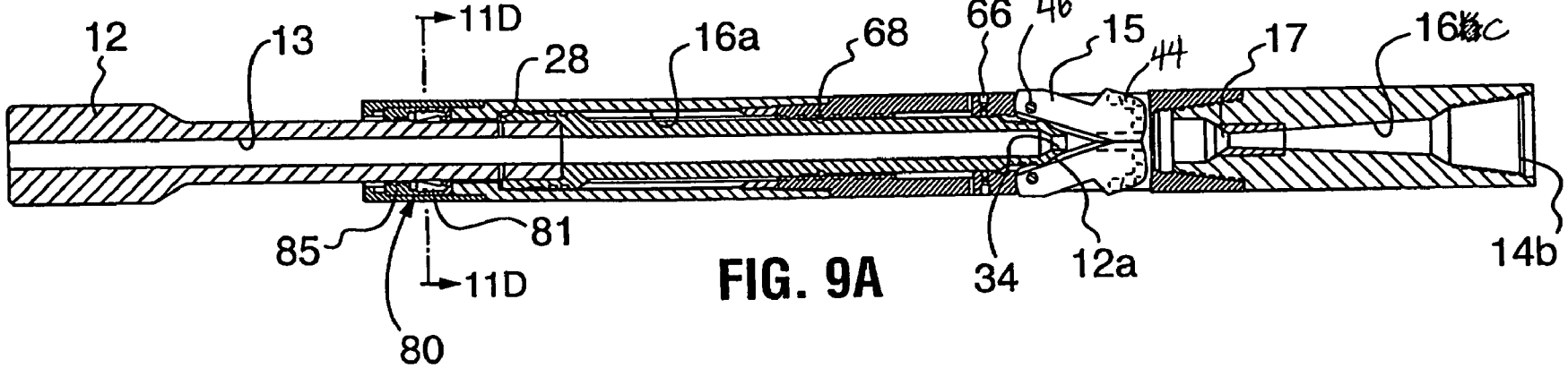
FIG. 9A is an axial sectional view through another under reamer in accordance with the present invention with the under reamer arms in the retracted position. Reference is made to the sectional orientation indicated by line 9A-9A of FIG. 10A.
Figure 9B:
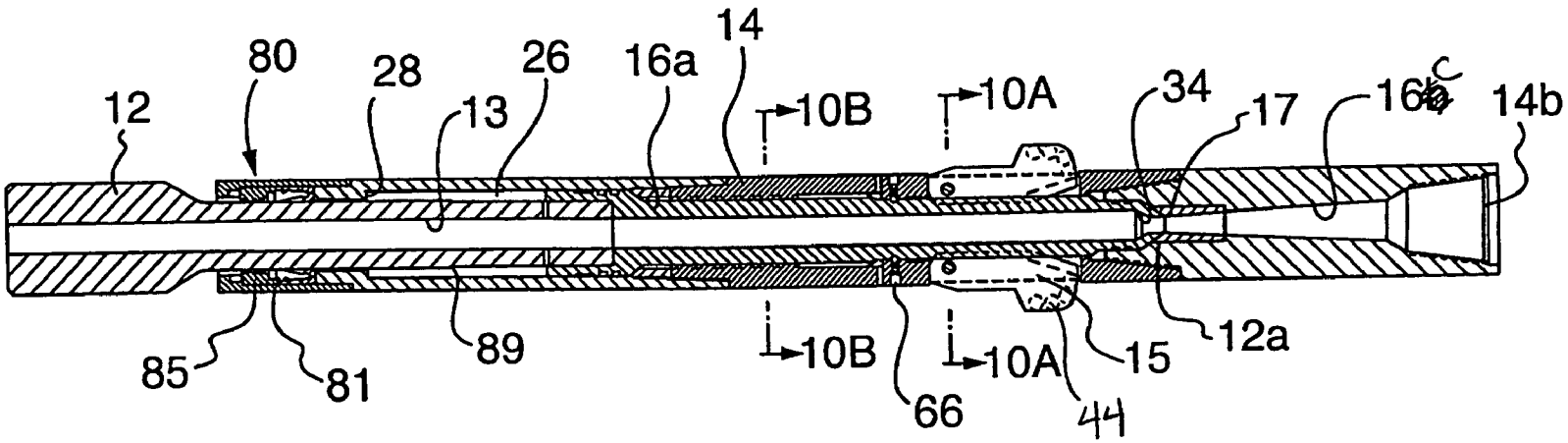
FIG. 9B is an axial sectional view corresponding with FIG. 9A with the under reamer arms in the expanded position.
Figure 10A:
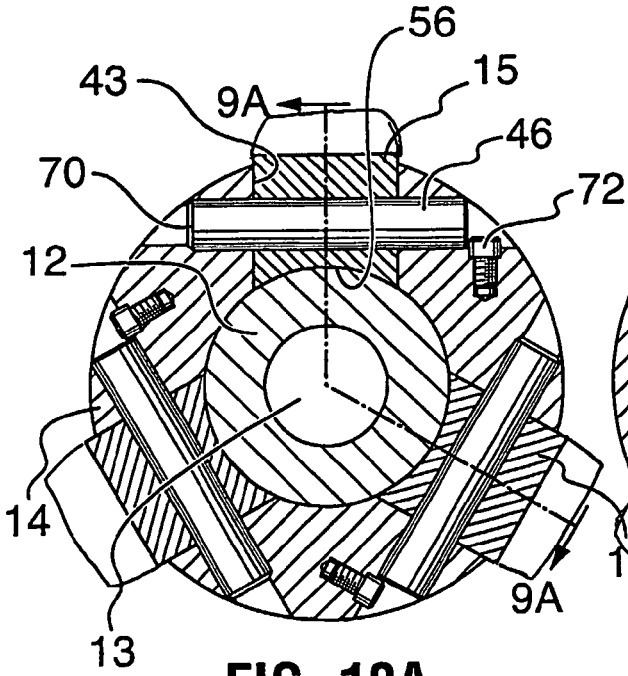
FIG. 10A is a transverse sectional view through the under reamer of FIG. 9B taken along line 10A-10A.
Figure 10B:
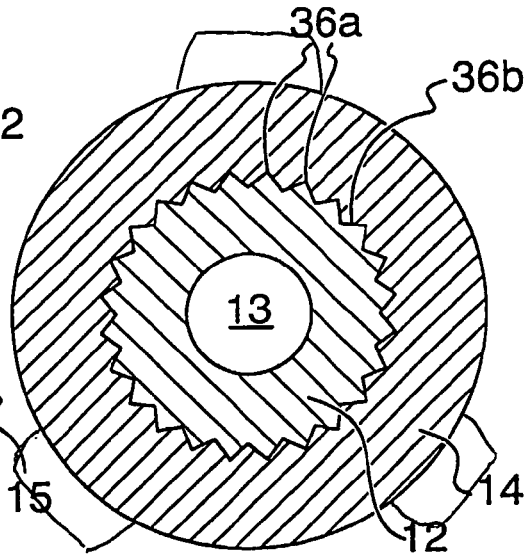
FIG. 10B is a transverse sectional view through the under reamer of FIG. 9B taken along line 10B-10B.
Figure 11A:
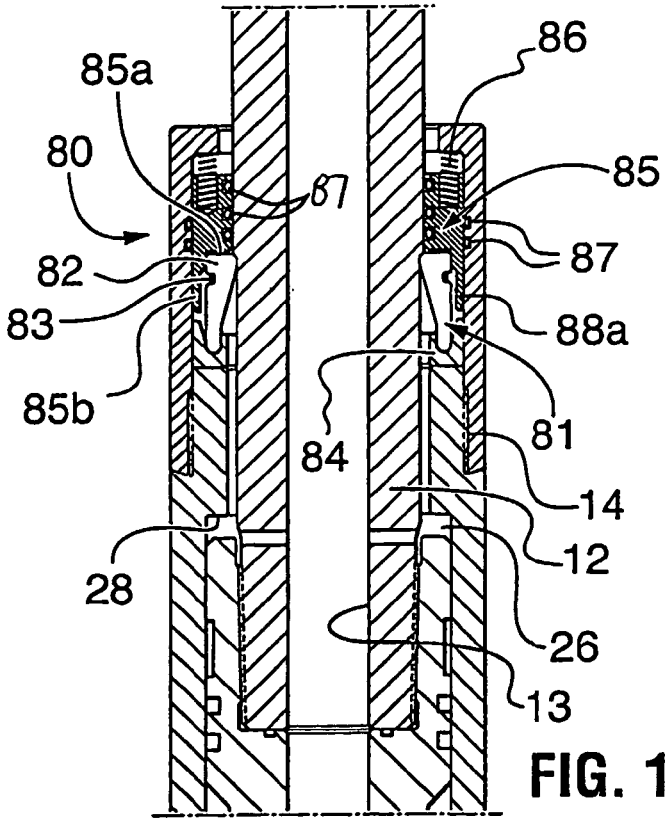
FIG. 11A is an enlarged axial sectional view of the tripping lock assembly of the under reamer of FIG. 9A.
Figure 11B:
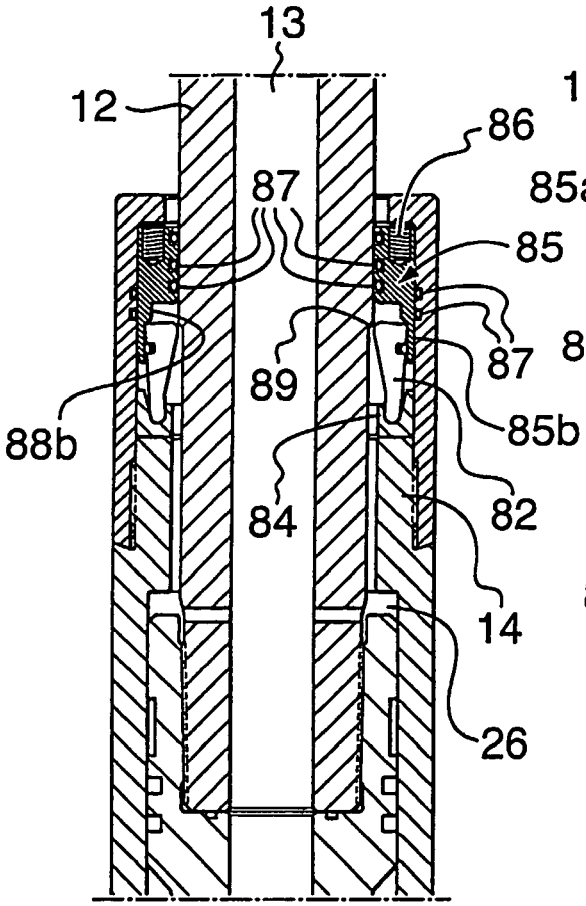
FIG. 11B is a view corresponding to FIG. 11A with the tripping lock assembly in the process of being unlocked.
Figure 11C:
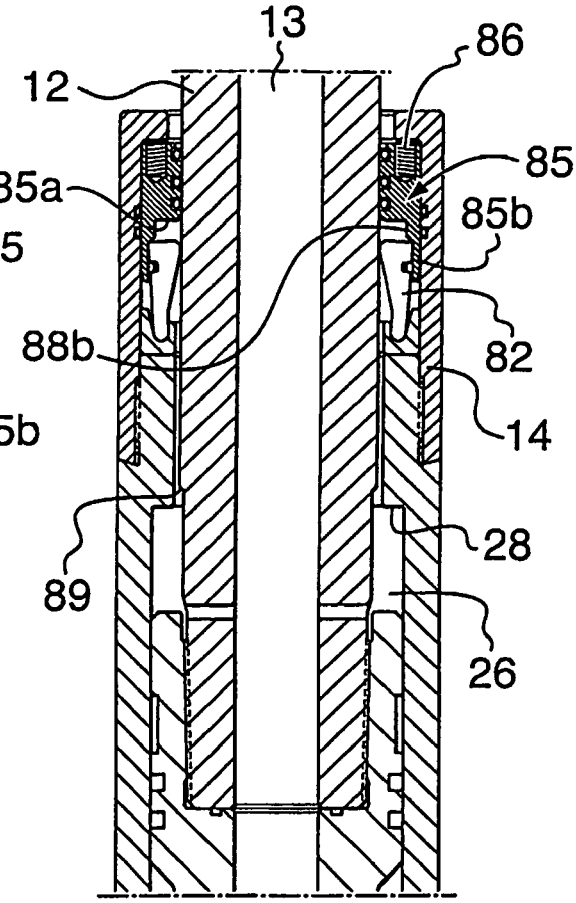
FIG. 11C is a view corresponding to FIG. 11A and following from FIG. 11B, showing the tripping lock in the unlocked position, while the housing is moving up.
Figure 11D:
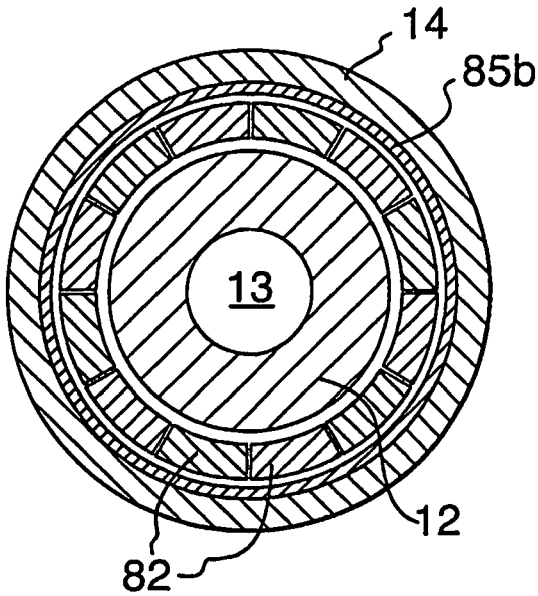
FIG. 11D is a transverse sectional view through the under reamer of FIG. 9A taken along line 11D-11D.
Figure 12A:
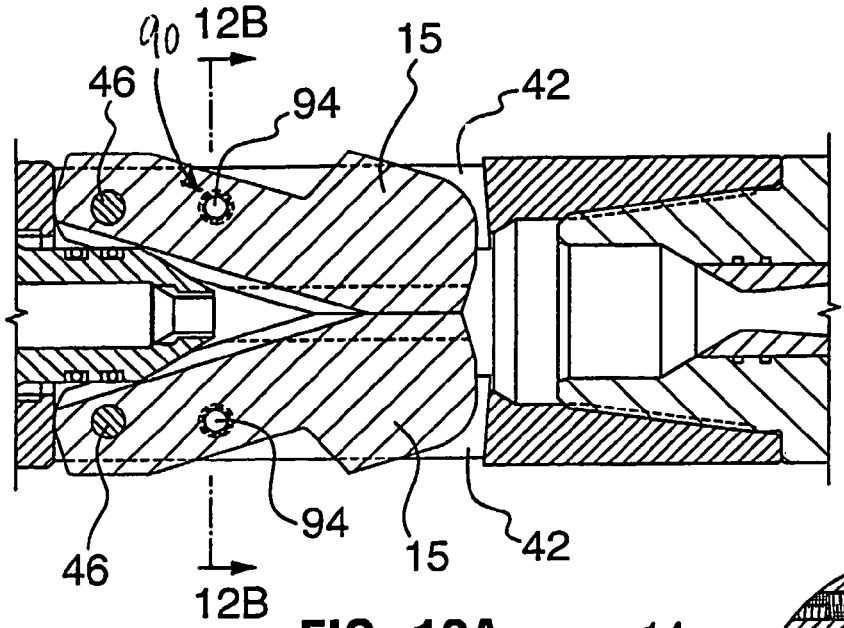
FIG. 12A is a schematic sectional view of the under reamer arm section of an under reamer according to the present invention with the under reamers releasably locked in the retracted position.
Figure 12B:
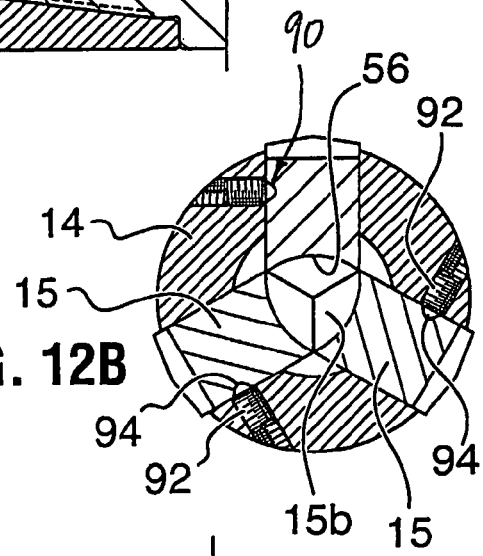
FIG. 12B is a transverse sectional view through the under reamer of FIG. 12A along line 12B-12B.
Figure 12C:
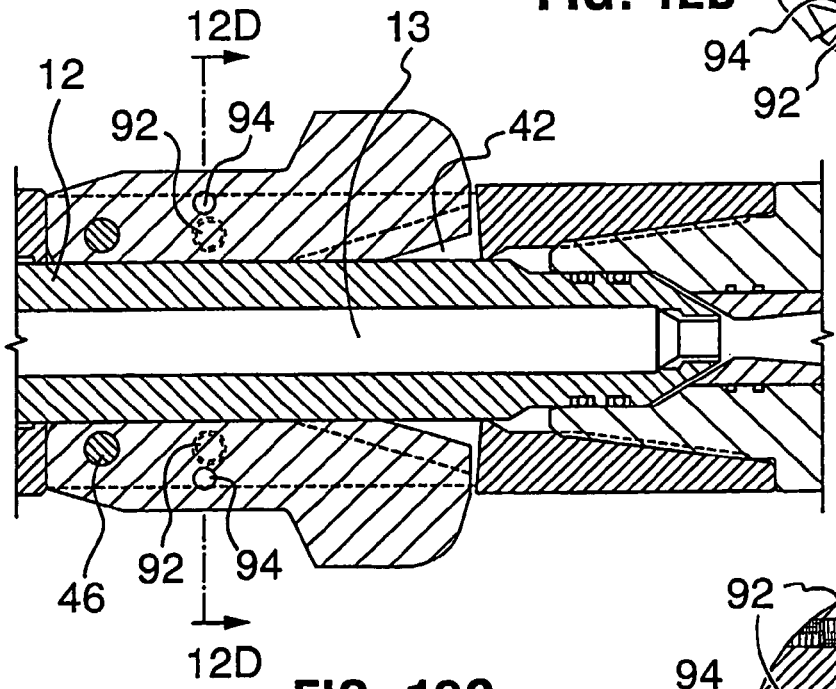
FIG. 12C is a schematic sectional view of the under reamer of FIG. 12A with the under reamer arms in the expanded position.
Figure 12D:
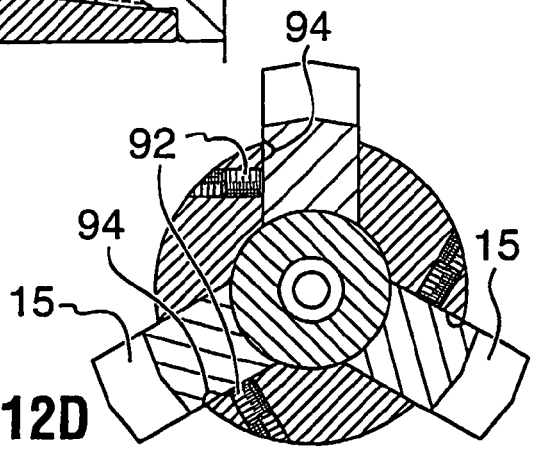
FIG. 12D is a transverse sectional view along line 12D-12D of FIG. 12C.

In use, under reamer arms 15 are pivotally moveable between a stored position (FIG. 9A) and an expanded position (FIG. 9B). In the stored position, the housing is in a lower position relative to the mandrel wherein there is a space between end 12*a* of the mandrel and shoulder 17. Under reamer arms 15 in the stored position fit together along the center axis of the upper inner bore 16*a*. In the illustrated embodiment, the arms include wedge shaped ends 15*b* (FIG. 12B) that permit the arms to fit closely together, thereby reducing their stored outer diameter.

The under reamer is tripped through the borehole in this stored condition. It is desirable for control and ease of tripping that the under reamer arms remain in the stored position and the housing be in a fixed position on the mandrel. Thus, in this embodiment, detents 92 are biased into recesses 94 on the arms to prevent them from pivoting out from the housing by gravity when in a deviated hole. In addition, mandrel 12 and housing 14 are locked in relative position by locking assembly 80. In particular, in tripping locked position piston 85 is biased by springs 86 into chamber 26 and lugs 82 are engaged between second level 88*b* of wall 85*b* and mandrel 12 under shoulder 89. Since lugs are pivotally mounted at their bases on housing 14 and wall 85*b* is biased behind lugs 82, the lugs cannot bias outwardly past shoulder 89 and, thus, mandrel 12 cannot move relative to housing 14. Weight on bit would not be sufficient to move the housing relative to the mandrel.

For operation of the under reamer, cutter-supporting portions 43 of the arms must be extended beyond the outer surface of the housing. Under reamer arms 15 are driven radially outwardly when the housing is moved upwardly over the mandrel. In particular, the arms are driven outwardly by initially the force of fluid jetting through nozzle 34 and then by abutment of the rear surfaces 56 of the arms against end 12*a* of the mandrel. Thus, when it is desired to expand under reamer arms 15 radially outwardly fluid pressure is applied or increased from surface such that restriction nozzle 34 creates a pressure differential between bore 13 and the borehole about the under reamer. In so doing, fluid pressure acts against piston face 85*a* of lock 80 and piston face 28 of housing 14. Preferably, springs 86 are selected to permit actuation of piston 85 at a lower pressure than movement of housing through piston face 28 such that lock 80 is released before pressure is sufficient to move the housing.

As fluid pressure acts against face 85*a*, piston 85 is driven against springs 86. This causes wall 85*b* to move relative to lugs 82 such that the lugs drop onto first level 88*a* where there is sufficient space for the lugs to be driven radially outwardly by fluid pressure. As fluid pressure is further increased, housing 14 begins to be drawn upwardly over the mandrel, driving the lugs past shoulder 89.

When housing 14 is forced upwardly, the mandrel is forced against arms 15. While, the arms may already have been released from detents 92 by the pressure of fluid jetting through nozzle 34, mandrel 12 will force the arms fully into their expanded position and support them in this expanded position. Housing 14 is drawn up over mandrel until end 12*a* is in close proximity to shoulder 17 (FIG. 9B). In this position, detents 66 land in groove 68 and releasably lock the housing relative to the mandrel until the force driving the detents into engagement with groove 68 is overcome.

In the expanded position, the arms are held out by the mandrel. Slots 42 and under reamer arms 15 are formed with consideration to each other such that the slots limit the radial outward pivotal expansion of the arms and such that the slots closely surround and support the arms along their sides. In addition, mandrel 12 and rear surfaces 56 of the arms are similarly curved such that the arms are supported by the mandrel.

Should the pressure drop during operation, the arms will remain in the operational outwardly expanded position provided detents 66 remain engaged in groove 68. Should it be desirable to return the under reamer arms to the stored position, force is applied to drive the detents out of engagement with groove 68, as by reducing fluid pressure and pulling the under reamer upwardly to engage the arms against the casing shoe, so that mandrel 12 can be retracted from the housing.

Figure 13A:
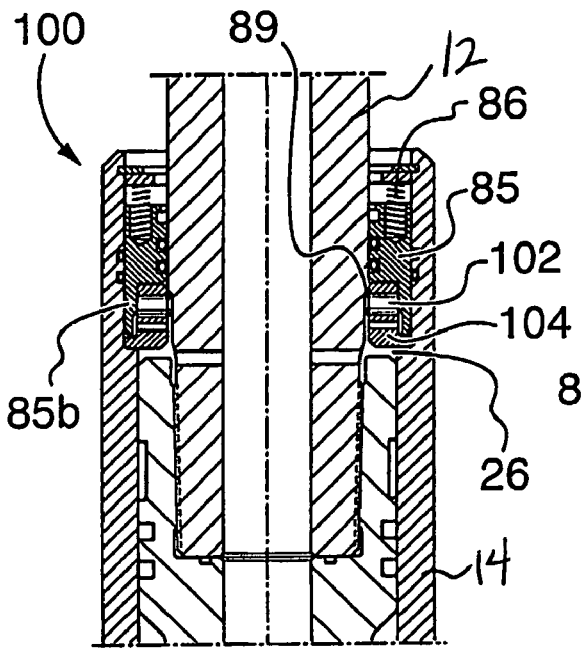
FIG. 13A is an enlarged axial sectional view of another tripping lock assembly useful in the present invention.
Figure 13B:
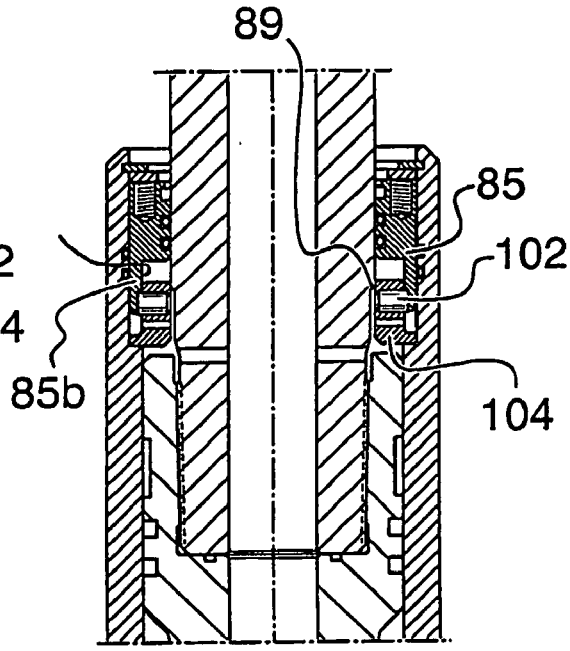
FIG. 13B is a view corresponding to FIG. 13A with the tripping lock assembly in the process of being unlocked.
Figure 13C:
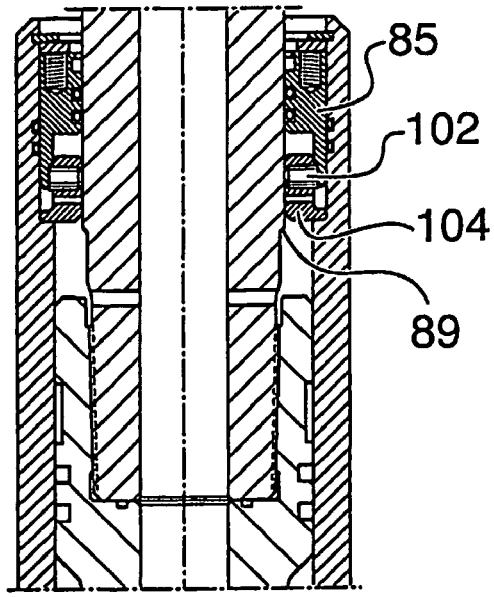
FIG. 13C is a view corresponding to FIG. 13A and following from FIG. 13B, showing the tripping lock in the unlocked position, while the housing is moving up.

Another tripping lock assembly is shown in FIGS. 13A to 13B. This tripping lock assembly is similar to that of FIG. 11, except that rather than collet 81, lock pins 102 and floating ring 104 are used. Ring 104 floats in chamber 26 below piston 85 and fluid pressure can by pass the ring to act on piston 85, as in FIG. 11. Ring 104 carries a plurality of pins 102 that extend through bores in the ring, but are moveable along their axis to move in and out, as permitted by the space about them. When housing 14 is locked by the tripping lock in a lower position on the mandrel (FIG. 13A), ring 104 is positioned up against piston 85 with pins 102 jammed between second level 88*b* and mandrel 12 under shoulder 89. In this position, pins 102 butt against shoulder 89 to prevent the mandrel from moving further into the housing. However, when fluid pressure is applied to bore 13 and communicated to chamber 26, the piston is driven against springs 86 to move upwardly. This moves the wall 85*b* relative to ring 104 so that the pins become positioned adjacent the first level 88*a*. This provides room for pins 102 to move axially away from the mandrel so that the shoulder can move past the pins.

Although preferred embodiments of the present invention have been described in some detail hereinabove, those skilled in the art will recognise that various substitutions and modifications may be made to the invention without departing from the scope and spirit of the appended claims.

The embodiments of the invention in which an exclusive property or privilege is claimed are defined as follows:

1. An under reamer for expanding a borehole through an earthen formation, the under reamer comprising: a mandrel including an end for connection into a drill string and an opposite end; a housing including an inner bore, telescopically disposed over the mandrel and axially moveable relative to the mandrel, the housing being rotationally moveable with the mandrel; a hydraulic pressure chamber between the housing and the mandrel for driving the housing axially relative to the mandrel; an under reamer arm carried on the housing, the under reamer arm formed as a block and including an outer facing surface, a rear surface and top, bottom and side surfaces extending between the outer facing surface and the rear surface; and a cutter-supporting portion on the under reamer arm outer facing surface in which poly-crystalline diamond compact cutters are mounted, the under reamer arm being moveable by driving the housing axially over the mandrel between a retracted position extending into the housing inner bore and an expanded position wherein the under reamer arm is pivoted out of the housing inner bore and supported by the mandrel such that the cutter-supporting portion is exposed for use to enlarge a borehole.

2. The under reamer of claim 1 further comprising a slot in the housing extending between the housing outer surface and the housing inner bore and the under reamer arm being pivotally mounted therein.

3. The under reamer of claim 2 wherein the slot includes side, top and bottom surfaces that extend between the housing outer surface and the housing inner bore and wherein the cutter supporting portion of the arm is a protrusion on the outer facing surface of the arm.

4. The under reamer of claim 3 wherein in the expanded position, at least a portion of the arm top, bottom and side surfaces remain in the slot with the cutter supporting portion extending outwardly beyond the housing outer surface.

5. The under reamer of claim 2, further comprising a releasable lock between the under reamer arm and its slot to releasably lock the arm in the slot when in the retracted position.

6. The under reamer of claim 1 further comprising a second under reamer arm including a rear surface, and a portion of each of the rear surfaces being wedge-shaped to permit the under reamer arms to fit together in the housing inner bore about the inner bore center axis.

7. The under reamer of claim 6 wherein the mandrel includes a contour on its surface which supports the under reamer arms in the expanded position and the under reamer arms each include another portion of their rear surface that is curved to substantially conform to the contour of the mandrel surface.

8. The under reamer of claim 1, further comprising an operational lock assembly operable to releasably lock the mandrel relative to the housing in an axial position corresponding to the expanded position.

9. The under reamer of claim 1, further comprising a tripping lock assembly operable to releasably lock the mandrel relative to the housing in an axial position corresponding to the retracted position.

10. The under reamer of claim 9, wherein the tripping lock assembly is operable to unlock by application of a selected fluid pressure to the mandrel.

11. An under reamer for expanding a borehole through an earthen formation, the under reamer comprising: a mandrel including an end for connection into a drill string and an opposite end; a housing telescopically disposed over the mandrel and axially moveable relative to the mandrel, the housing being rotationally moveable with the mandrel; at least three under reamer arms carried on the housing, the under reamer arms each including a cutter-supporting portion and a rear surface including a wedge-shaped portion; and a slot for each under reamer arm, the slots extending from the outer surface of the housing to the housing inner bore; the under reamer arms each being pivotally moveable within their slots between a stored position in the slot and extending into the inner bore with their wedge-shaped portions fitting together and an expanded position wherein the cutter-supporting portions extend beyond the outer surface of the housing for use to enlarge a borehole.

12. The under reamer of claim 11 wherein the slots include sides and the under reamer arms include sides and the sides of the slots are formed to substantially conform to the sides of the arms.

13. The under reamer of claim 11 wherein the slots each include an upper end and the under reamer arms each include an upper surface and the upper ends of the slots are formed to limit the pivotal movement of the arms into their extended position by abutment of the arms upper surfaces against the upper ends of the slots.

14. The under reamer of claim 11, wherein the upper ends of the slots substantially conform to the shape of the upper surfaces of the under reamer arms.

15. The under reamer of claim 11 wherein the mandrel includes an outer surface and the rear surfaces of the under reamer arms are each shaped along a second portion thereof to substantially conform to the outer surface of the mandrel.

16. The under reamer of claim 11 further comprising a releasable lock between at least one under reamer arm and the slot in which it is mounted to releasably lock the under reamer arm in the stored position within the slot.

17. The under reamer of claim 11 wherein the cutter-supporting portion has mounted thereon poly-crystalline diamond compact cutters.

18. The under reamer of claim 11 further comprising a raised surface on the housing outer surface below the slots.

19. An under reamer for expanding a borehole through an earthen formation, the under reamer comprising: a mandrel including an uphole end for connection into a drill string and an opposite end and an inner bore extending between the uphole end and the opposite end; a housing including an upper inner bore, a lower inner bore and an opening to the lower inner bore, the mandrel being telescopically disposed and axially moveable within the upper inner bore into abutment against the opening to the lower inner bore, the housing being rotationally moveable with the mandrel; a plurality of under reamer arms carried on the housing, the under reamer arms each including a cutter-supporting portion in which cutters are mounted, the under reamer arms being moveable by driving the housing axially over the mandrel between a stored position extending into the upper inner bore of the housing and an expanded position wherein the under reamers arms are pivoted out of the housing upper inner bore and supported by the mandrel such that the cutter-supporting portions are exposed for use to enlarge a borehole; a fluid pressure chamber positioned between the housing and the mandrel and formed to accept pressurized fluid therein to drive the axial movement of the housing relative to the mandrel, a port from the mandrel inner bore to the pressure chamber to permit flow of pressurized fluid therethrough; and a restriction nozzle in the mandrel inner bore between the port and the opposite end of the mandrel to increase fluid pressure thereabove.

20. The under reamer of claim 19, wherein the housing lower inner bore is formed as a fluid diffuser.

21. The under reamer of claim 20 wherein the housing lower inner bore increases in inner diameter with distance from the opening.

22. The under reamer of claim 19 further comprising seals positioned between the opposite end and the opening to the lower inner bore to direct fluid from the mandrel to the lower inner bore.

23. The under reamer of claim 19 wherein the cutters are poly-crystalline diamond compact cutters.

24. The under reamer of claim 19 further comprising a raised surface on an outer surface of the housing below the under reamer arms.

25. An under reamer for expanding a borehole through an earthen formation, the under reamer comprising: a mandrel including an end for connection into a drill string and an opposite end; a housing including an inner bore, telescopically disposed over the mandrel and axially moveable relative to the mandrel, the housing being rotationally moveable with the mandrel; an under reamer arm carried on the housing, the under reamer arm formed as a block and including an outer facing surface, a rear surface and top, bottom and side surfaces extending between the outer facing surface and the rear surface; a cutter-supporting portion on the under reamer arm outer facing surface in which poly-crystalline diamond compact cutters are mounted; a slot in the housing extending between the housing outer surface and the housing inner bore and the under reamer arm being pivotally mounted therein; and a releasable lock between the under reamer arm and its slot, the under reamer arm being moveable by driving the housing axially over the mandrel between a retracted position extending into the housing inner bore and an expanded position wherein the under reamer arm is pivoted out of the housing inner bore and supported by the mandrel such that the cutter-supporting portion is exposed for use to enlarge a borehole, the releasable lock acting to releasably lock the arm in the slot when the arm is in the retracted position.

26. The under reamer of claim 25 wherein the slot includes side, top and bottom surfaces that extend between the housing outer surface and the housing inner bore and wherein the cutter supporting portion of the arm is a protrusion on the outer facing surface of the arm.

27. The under reamer of claim 25 wherein in the expanded position, at least a portion of the arm top, bottom and side surfaces remain in the slot with the cutter supporting portion extending outwardly beyond the housing outer surface.

28. The under reamer of claim 25 further comprising poly-crystalline diamond compact cutters installed on the cutter-supporting portion.

29. The under reamer of claim 25 further comprising a raised surface on the housing outer surface below the slot.

30. An under reamer for expanding a borehole through an earthen formation, the under reamer comprising: a mandrel including an end for connection into a drill string and an opposite end; a housing including an inner bore, telescopically disposed over the mandrel and axially moveable relative to the mandrel, the housing being rotationally moveable with the mandrel; an under reamer arm carried on the housing, the under reamer arm formed as a block and including an outer facing surface, a rear surface and top, bottom and side surfaces extending between the outer facing surface and the rear surface; a cutter-supporting portion on the under reamer arm outer facing surface in which poly-crystalline diamond compact cutters are mounted, the under reamer arm being moveable by driving the housing axially over the mandrel between a retracted position extending into the housing inner bore and an expanded position wherein the under reamer arm is pivoted out of the housing inner bore and supported by the mandrel such that the cutter-supporting portion is exposed for use to enlarge a borehole; and a second under reamer arm including a rear surface, and a portion of each of the under reamer arm rear surfaces being wedge-shaped to permit the under reamer arms to fit together in the housing inner bore about the inner bore center axis.

31. The under reamer of claim 30 wherein the mandrel includes a contour on its surface which supports the under reamer arms in the expanded position and the under reamer arms each include another portion of their rear surface that is curved to substantially conform to the contour of the mandrel surface.

32. The under reamer of claim 30 further comprising poly-crystalline diamond compact cutters installed on the cutter-supporting portion.

33. The under reamer of claim 30 further comprising a raised surface on the housing outer surface below the slot.

* * * * *